US010058982B2

(12) United States Patent
Hu et al.

(10) Patent No.: US 10,058,982 B2
(45) Date of Patent: Aug. 28, 2018

(54) COMBINATION OF WRENCH AND DRIVING DEVICE

(71) Applicant: Bobby Hu, Taichung (TW)

(72) Inventors: Bobby Hu, Taichung (TW); Chi-Jui Lo, Taichung (TW)

(73) Assignee: Bobby Hu, Taichung (TW)

( * ) Notice: Subject to any disclaimer, the term of this patent is extended or adjusted under 35 U.S.C. 154(b) by 274 days.

(21) Appl. No.: 14/947,472

(22) Filed: Nov. 20, 2015

(65) Prior Publication Data

US 2017/0057056 A1 Mar. 2, 2017

(30) Foreign Application Priority Data

Sep. 2, 2015 (TW) ..... 104129084 A

(51) Int. Cl.
*B25B 13/46* (2006.01)
*B25B 23/00* (2006.01)

(52) U.S. Cl.
CPC ..... *B25B 13/463* (2013.01); *B25B 23/0007* (2013.01); *B25B 23/0035* (2013.01)

(58) Field of Classification Search
CPC ..... B25B 13/463; B25B 23/0007; B25B 23/0035; B25B 13/46; B25B 23/00; B25B 13/462; B25B 15/04; B25B 13/00
See application file for complete search history.

(56) References Cited

U.S. PATENT DOCUMENTS 5,761,973 A * 6/1998 Tung ..... B25B 13/461 81/177.85
8,931,377 B2 * 1/2015 Wang ..... B25B 23/0035 81/121.1
2004/0214137 A1 * 10/2004 Walton ..... A61C 8/0089 433/141
2009/0324326 A1 * 12/2009 Lin ..... B25B 15/001 403/322.2

* cited by examiner

*Primary Examiner* — Robert Scruggs
(74) *Attorney, Agent, or Firm* — Muncy, Geissler, Olds & Lowe, P.C.

(57) ABSTRACT

A combination of wrench and driving device includes a wrench, a first driver having an axis and a combining part on one end and a connecting part on the other end thereof, a second driver having a non-circular outer edge, and a retaining mechanism. The wrench has a driving part. The combining part is removably engaged with the driving part, and one end of the combining part away from the connecting part has a retaining edge. The second driver is axially coupled with the connecting part along the axis. The retaining mechanism, when the second driver rotates toward any vertical direction vertical around the axis to be coupled, prevents the profile of the combining part and the profile of the non-circular outer edge from completely axially overlapping each other. The non-circular outer edge is retained against the driving part of the wrench.

14 Claims, 6 Drawing Sheets

COMBINATION OF WRENCH AND DRIVING DEVICE

BACKGROUND OF THE INVENTION

1. Field of the Invention

The present invention relates to a combination of wrench and driving device, wherein the wrench is prevented from being displaced upward or downward against the driving device during operation.

2. Description of the Related Art

Referring to FIG. 1 and FIG. 2, a traditional ratchet wrench and relative assembly includes a ratchet wrench 1, a driver 2, and a sleeve 3. The driver 2 has a hexagonal engaging part 4 for being engaged with a ratchet ring 5 of the ratchet wrench 1, such that a driving head 6 on the lower end of the driver 2 is exposed for engaging the sleeve 3, whereby the ratchet wrench 1 drives screw members in different sizes. The driver 2 is embedded with a resilient member 7 on the periphery of the engaging part 4, such that the engaging part 4 is allowed to be stably positioned and engaged within the ratchet ring 5.

However, when the screw member is rotated to be fastened, the ratchet wrench 1 is operationally rotated around the screw member, and simply the resilient member 7 does not provide a supporting force large enough. As a result, the ratchet wrench 1 easily moves downward against the driver 2, such that the user must move the ratchet wrench 1 upward to restore the ratchet wrench 1 back to the original position, failing to facilitate the operation of the ratchet wrench 1. Moreover, the issue of elastic fatigue possibly occurs upon the resilient member 7 and thereby negatively impacts the operation of the ratchet wrench 1.

Furthermore, when the ratchet wrench 1 is to be detached from the screw member, if the temporary seizure occurs between the sleeve 3 and the screw member, the ratchet wrench 1 is easily detached from the driver 2 during moving upward. As a result, when the ratchet wrench 1 is removed, the sleeve 3 and the driver 2 remain on the screw member.

SUMMARY OF THE INVENTION

For improving issues aforementioned, a combination of wrench and driving device is disclosed, wherein the wrench is prevented from being displaced upward or downward against the first driver, thus resolving known disadvantages.

For achieving the objective above, a combination of wrench and driving device is provided, comprising:

a wrench having a driving part on one end thereof;

a first driver provided with an axis, a combining part and a connecting part disposed on two ends of the axis of the first driver, respectively, the combining part removably combined with the driving part, a retaining edge disposed on one end of the combining part away from the connecting part;

a second driver, coupled with the connecting part along the axis and having a non-circular outer edge which is in a size capable of being engaged by the driving part; and a retaining mechanism, preventing the profile of the combining part and the profile of the non-circular outer edge from completely axially overlapping each other along the axis when the second driver rotates toward any vertical direction around the axis to be coupled, the non-circular outer edge retained against the driving part of the wrench.

With such configuration, when the second driver is engaged with the connecting part of the first driver, a retaining effect is produced between the first driver and the second driver, preventing the wrench from being displaced downward against the first driver during rotationally screwing. Furthermore, when the wrench is being detached from the screw member, a retaining effect produced by the retaining edge of the first driver also facilitates the first driver and the second driver being disengaged altogether, preventing the wrench and the first driver from being displaced against each other.

DETAILED DESCRIPTION OF THE INVENTION

Figure 1:
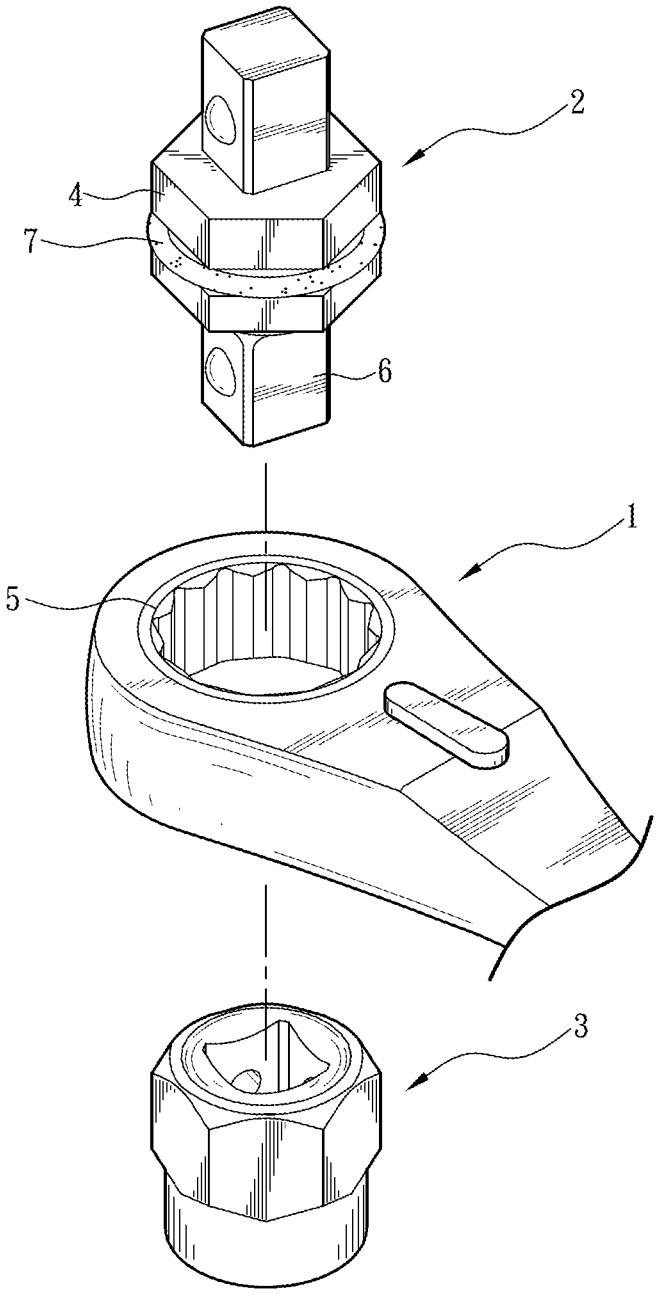
Prior Art FIG. 1
FIG. 1 is a perspective view of the known ratchet wrench and the assembly thereof.
Figure 2:
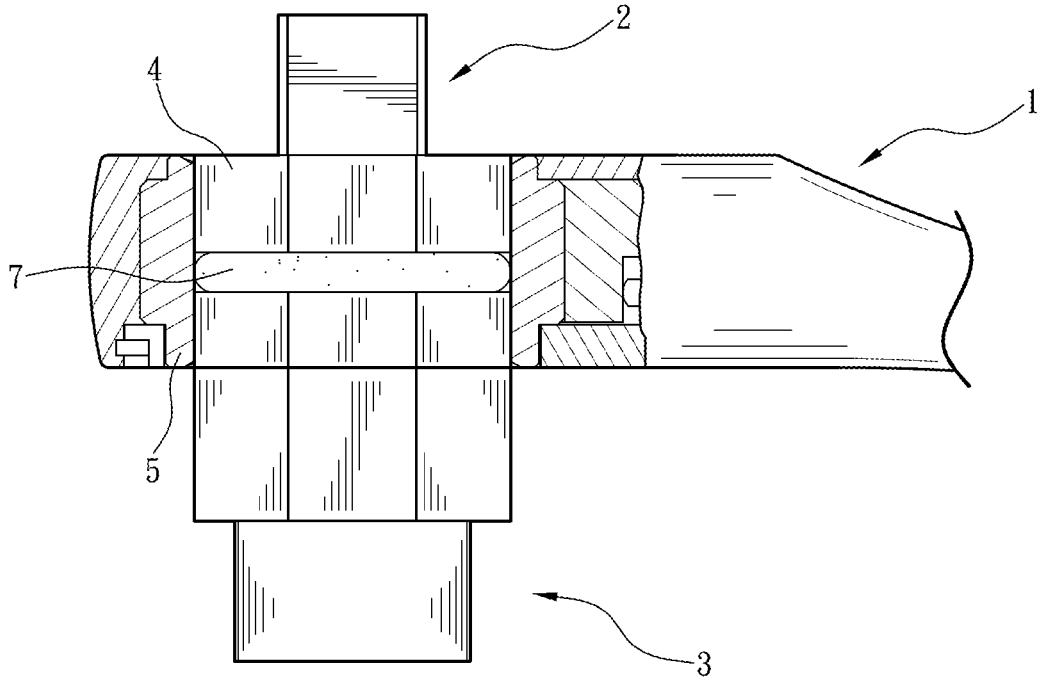
Prior Art FIG. 2
FIG. 2 is a schematic view illustrating the combination of the known ratchet wrench and the assembly thereof.
Figure 3:
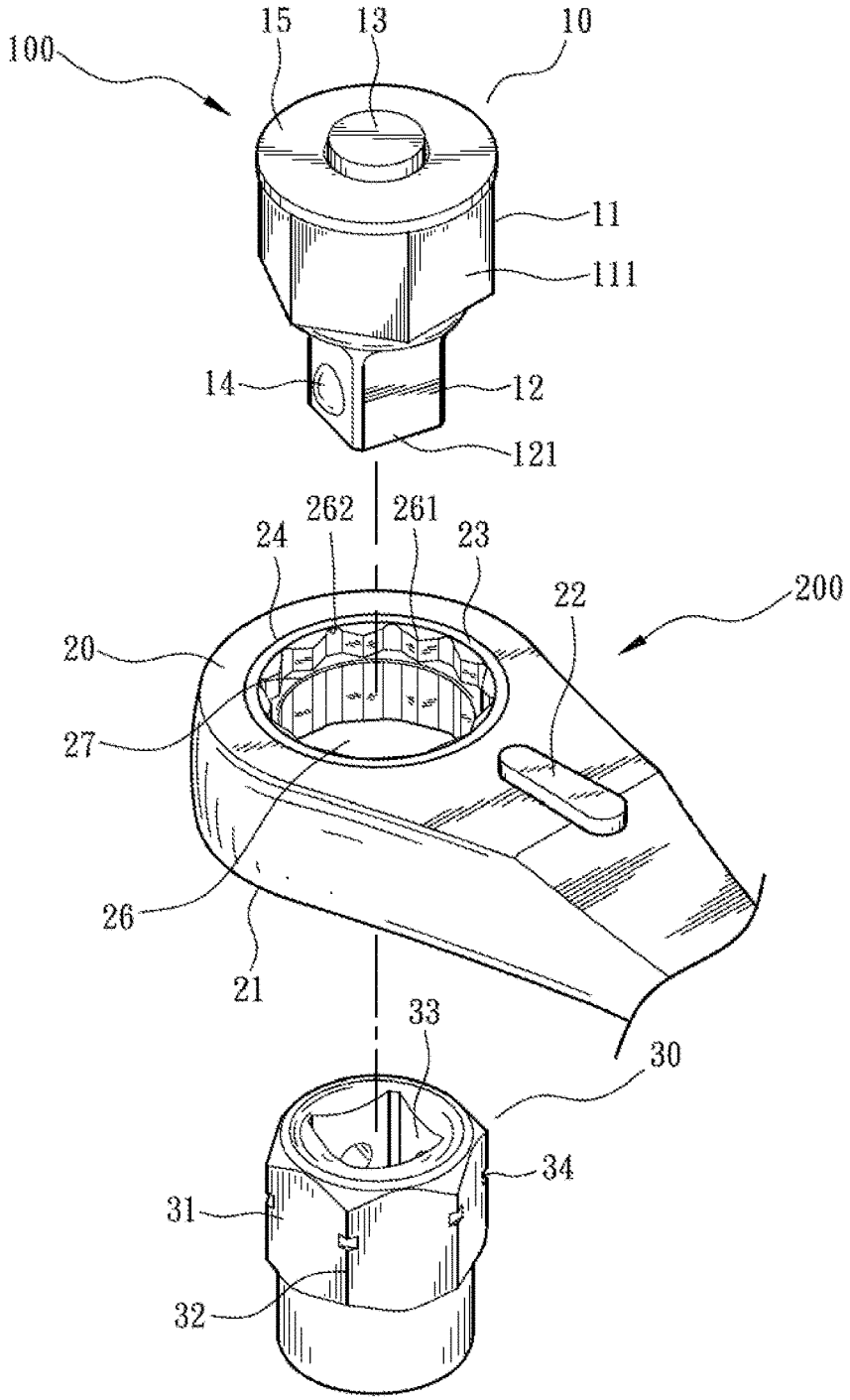
FIG. 3 is a perspective view of the wrench and the driving device in accordance with the present invention.

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 3 to FIG. 7, a combination of wrench and driving device provided by the present invention comprises a driving device 100 and a wrench 200. The driving device 100 includes a first driver 10 and a second driver 30. The first driver 10 and the second driver 30 are allowed to be coupled with each other, and the first driver 10 is removably combined to the wrench 200. In the preferred embodiment, the first driver 10 is an adapter, and the second driver 30 is a sleeve.

The wrench 200, in the preferred embodiment, is a ratchet wrench provided with a first side 20 and a second side 21 oppositely disposed thereon, respectively. A driving part 23, which is a ratchet ring in the preferred embodiment, is rotatably disposed between the first side 20 and the second side 21, and is allowed to be triggered to rotate clockwise or anticlockwise by a direction switching member 22. Also, the driving part 23 is provided with a first edge 24 and a second edge 25 oppositely disposed thereon, respectively. The first edge 24 and the first side 20 are positioned on the same platform. The second edge 25 and the second side 21 are positioned on another platform. The wrench 200 provided by the present invention is not limited to be a ratchet wrench and also allowed to be a box-end wrench or the like. For example, when the wrench 200 is a box-end wrench, the driving part 23 is integrally formed on the box-end wrench, which is the receiving portion of the box-end wrench for receiving the screw member.

A polygonal driving slot 26 passes through the driving part 23 and is provided with plural first inner edges 261 and plural second inner edges 262 arranged in alternate order with each other to form a ring shape. Distance from the center of the driving slot 26 to the first inner edges 261 is smaller than the distance from the center of the driving slot to the second inner edges 262. In the preferred embodiment, the first inner edges 261 and the second inner edges 262 are both provided in a number of twelve, such that the driving slot 26 is formed in a dodecagonal shape, with a total of twelve interior angles provided. Moreover, the inner edge of the driving slot 26 is embedded with a resilient member 27.

The first driver 10 has an axis X. A combining part 11 is disposed on one end of the first driver 10 along the axis X. The combining part 11 is removably combined to the driving slot 26 of the driving part 23 of the wrench 200, such that the resilient member 27 contacts the combining part 11 for providing a stable combination structure. The height of the combining part 11 is equal to the distance from the first edge 24 to the second edge 25 of the driving part 23.

A connecting part 12 is disposed on the other end of the first driver 10 away from the combining part 11 along the axis X, so as to be coupled with the second driver 30, wherein the connecting part 12 is formed in a tetragonal column shape.

The second driver 30 has a non-circular outer edge 31 on one end thereof, which is formed in a hexagonal column shape in the preferred embodiment and provided with six corners 32. Also, a tetragonal receiving bore 33 is disposed at the center of the non-circular outer edge 31 of the second driver 30 for coupling with the connecting part 12. Each corner 32 is mounted with an engaging groove 34, respectively. A hexagonal driving bore 35 is concavely disposed on the other end of the second driver 30 away from the non-circular outer edge 31 for receiving the screw member. The second driver 30 is allowed to be coupled with the connecting part 12 along the axis X. Moreover, the size of the non-circular outer edge 31 of the second driver 30 is capable of being engaged by the driving slot 26 of the driving part 23, whereby the second driver 30 is removably combined to the wrench 200. When the non-circular outer edge 31 of the second driver 30 is combined to the driving slot 26, the resilient member 27 is engaged in the engaging grooves 34 mounted on the corners 32, such that the second driver 30 is stably positioned in the driving slot 26, facilitating the screwing operation of the wrench 200.

A retaining mechanism is provided, such that when the second driver 30 rotates toward any vertical direction around the axis X to be coupled, the profile of the combining part 11 and the profile of the non-circular outer edge 31 are prevented from completely axially overlapping each other along the axis X, whereby the non-circular outer edge 31 of the second driver 30 is retained against the second edge 25 of the driving part 23 of the wrench 200. Therefore, the wrench 200 is prevented from being displaced downward against the first driver 10 during operation.

Figure 4:
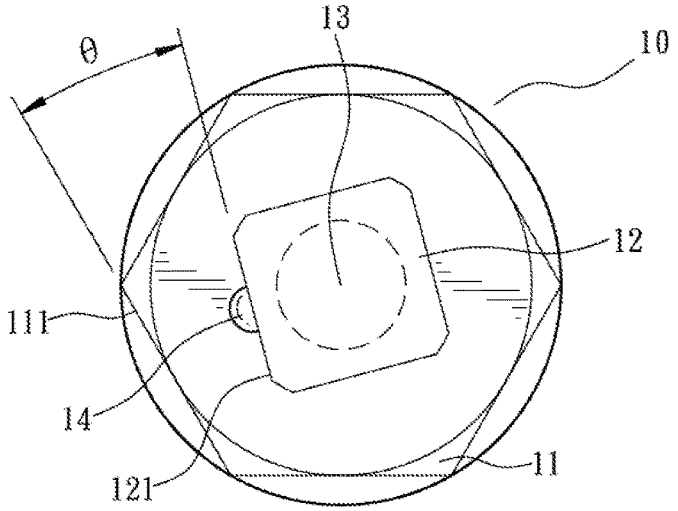
FIG. 4 is a bottom view of the first driver in accordance with the present invention.
Figure 6:
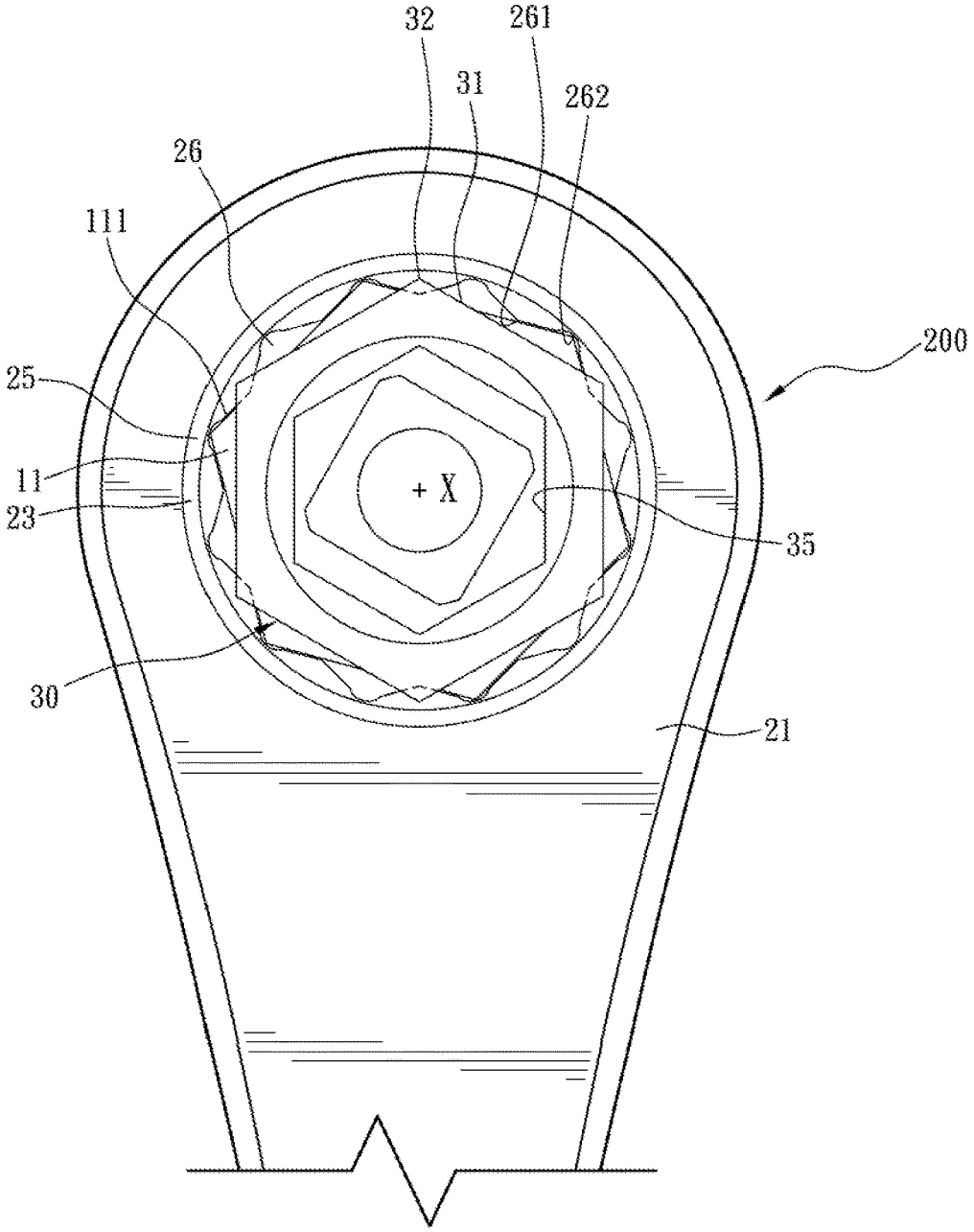
FIG. 6 is a bottom view of the wrench illustrating the installation status of the second driver positioned at a coupling position with the non-circular outer edge retained against the driving part.
Figure 7:
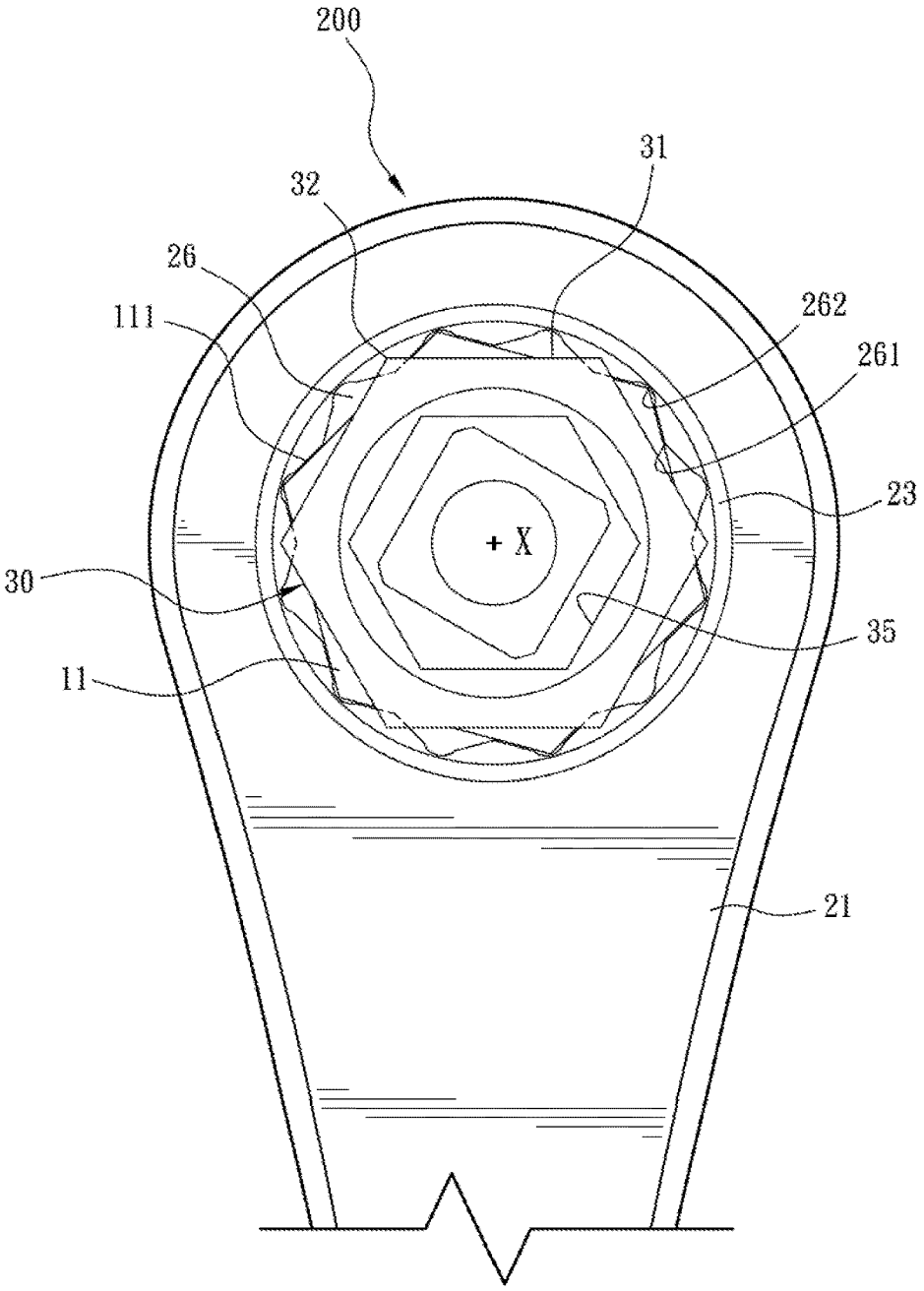
FIG. 7 is a bottom view of the wrench illustrating the installation status of the second driver positioned at another coupling position with the non-circular outer edge retained against the driving part.

The retaining mechanism comprises plural combining faces 111 disposed on the periphery of the combining part and plural connecting faces 121 disposed on the periphery of the connecting part 12, wherein a bias angle θ larger than zero degree is included between each connecting face 121 and each neighboring combining face 111. In the preferred embodiment, the bias angle θ is smaller than thirty degrees; preferably, the bias angle θ is fifteen degrees, as shown in FIG. 4. In the preferred embodiment, the combining part 11 is formed in a hexagonal column shape; the combining faces 111 are provided in a number of six; the connecting faces 121 are provided in a number of four. Also, referring to FIG. 4, each connecting face 121 faces two combining faces 111 and one corner part included by the two combining faces 111. Each corner part included between the two combining faces 111 is not in alignment with the central point of the neighboring connecting face 121, so that the length of one of the two combining faces 111 faced by the connecting face 121 is larger than the length of the other combining face 111 faced by the same connecting face 121, with a bias angle θ included by the connecting face 121 and the neighboring combining face 111, such that each connecting face 121 is not in parallel against the neighboring combining face 111. As a result, when the second driver 30 is coupled with the connecting part 12, the non-circular outer edge 31 is retained against at least one of the first inner edge 261, producing a retaining effect. When the non-circular outer edge 31 is formed in a hexagonal column shape in the preferred embodiment, the six corners 32 are retained against six of the twelve first inner edges 261. Preferably, the lengths of two lateral edges that include one corner 32 retained against the first inner edge 261 are equal, as shown in FIG. 6 and FIG. 7.

Further, the first driver 10 is longitudinally provided with a rod 13, and a ball member 14 is disposed on the outer edge of the connecting part 12. By pressing the rod 13, the ball member 14 correspondingly engages or disengages the second driver 30.

Still further, one end of the combining part 11 of the first driver 10 away from the connecting part 12 is provided with a ring shaped retaining edge 15, wherein the outer diameter of the retaining edge 15 is larger than the inner diameter of the driving slot 26. When the first driver 10 is combined to the wrench 200, and when the height of the combining part 11 is equal to the distance from the first edge 24 to the second edge 25 of the driving part 23, the retaining edge 15 resists against the first edge 24 of the wrench 200. However, such resisting configuration is a preferred embodiment but not a limitation upon the technical features of the present invention.

Figure 5:
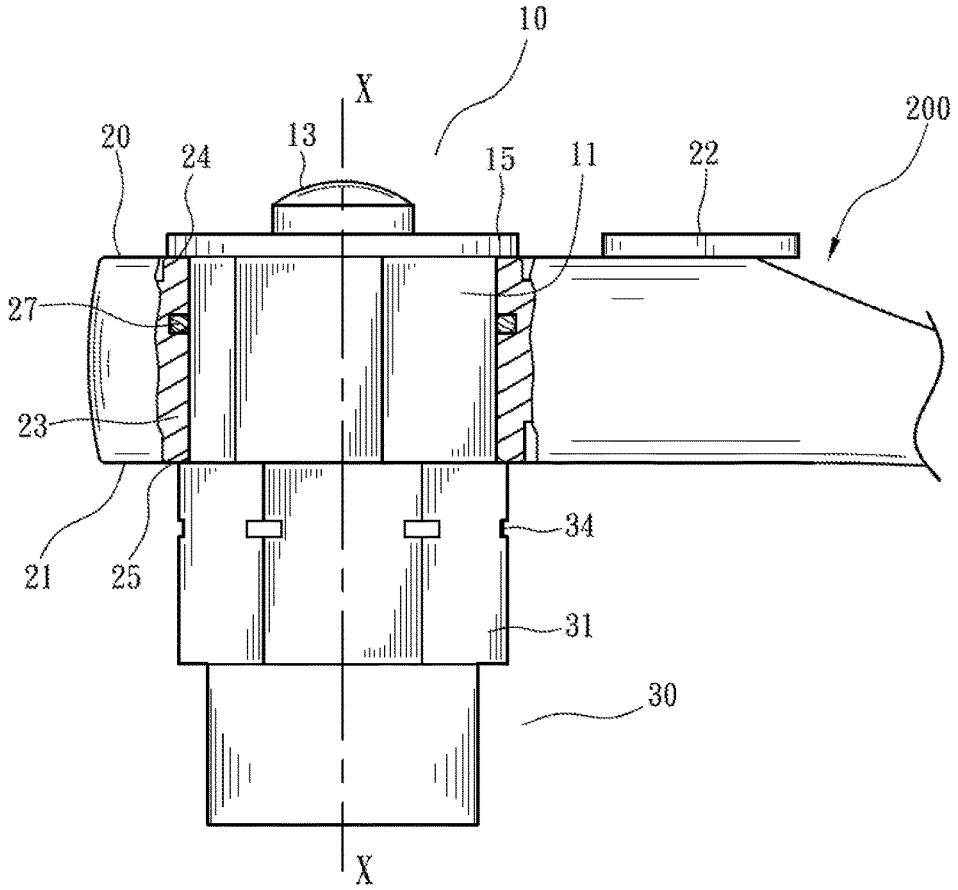
FIG. 5 is a schematic view illustrating the installation status of the first driver combined to the wrench and the installation status of the second driver coupled with the first driver.

As shown in FIG. 5, when the wrench 200 is to be detached from the screw member after the completion of the screwing operation, even if temporary seizure occurs between the second driver 30 and the screw member, the retaining effect produced by the retaining edge 15 prevents the wrench 200 from being displaced upward, such that the first driver 10 and the second driver 30 are still able to be disengaged from the screw member altogether. In other words, the situation of the wrench 200 being detached with the first driver 10 and the second driver 30 remaining on the screw member is prevented.

As shown in FIG. 6 and FIG. 7, the second driver 30 is optionally placed at different coupling positions. By use of the retaining mechanism aforementioned, whichever the coupling position the second driver 30 is placed at, the profile of the combining part 11 and the profile of the non-circular outer edge 31 are prevented from completely axially overlapping each other along the axis X. Therefore, when the combining part 11 and the non-circular outer edge 31 are both a hexagonal column, the section from a corner of the combining part 11 to the axis X and the section from a corresponding corner of the non-circular outer edge 31 neighboring the corner of the combining part 11 to the axis X include an fifteen-degree angle. As a result, the non-circular outer edge 31 of the second driver 30 is retained against the driving part 23, thereby preventing the wrench 200 from being displaced downward against the combining part 11.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A combination of wrench and driving device, comprising:

a wrench having a driving part on one end thereof, the driving part including a first edge and a second edge disposed in opposite to the first edge;

a first driver provided with an axis, a combining part and a connecting part disposed on two ends along the axis of the first driver, respectively, the combining part removably combined with the driving part, a retaining edge disposed on one end of the combining part away from the connecting part; and a second driver, coupled with the connecting part along the axis and having a non-circular outer edge which is in a size capable of being engaged by the driving part, the second driver further including a receiving bore at a center of the non-circular outer edge of the second driver for coupling the connecting part;

when the combining part of the first driver is combined to the driving part of the wrench, and the receiving bore of the second driver is coupled with the connecting part of the first driver, the retaining edge is at an outer side of the driving part and allowed to be retained against the first edge of the driving part, and the non-circular outer edge of the second driver is at the outer side of the driving part to be retained against the second edge of the driving part; therefore, when the second driver rotates toward any vertical direction around the axis to be coupled, the non-circular outer edge is retained against the driving part of the wrench, so as to prevent the profile of the combining part and the profile of the non-circular outer edge from completely axially overlapping each other along the axis.

2. The combination of claim 1, wherein the combining part and the non-circular outer edge are both formed in a hexagonal column shape, and a section from a corner of the combining part to the axis and a section from a corner of the non-circular outer edge neighboring the corner of the combining part to the axis include a fifteen-degree angle.

3. The combination of claim 1, wherein the first driver is an adapter, and the second driver is a sleeve.

4. The combination of claim 3, wherein the retaining mechanism comprises plural combining faces disposed on the periphery of the combining part and plural connecting faces disposed on the periphery of the connecting part, and a bias angle larger than zero degree is included between each connecting face and the neighboring combining face.

5. The combination of claim 4, wherein the bias angle is smaller than thirty degrees, the combining part is formed in a hexagonal column; the connecting part is formed in a tetragonal column shape.

6. The combination of claim 5, wherein the bias angle is fifteen degrees.

7. The combination of claim 3, wherein the height of the combining part is equal to the distance from the first edge to the second edge.

8. The combination of claim 3, wherein the driving part is formed in a polygonal driving slot mounted with at least one first inner edge and at least one second inner edge; the distance from the center of the driving part to the first inner edges is smaller than the distance from the center of the driving part to the second inner edges; the non-circular outer edge is retained against the first inner edge when the second driver is coupled with the connecting part.

9. The combination of claim 8, wherein the first inner edges and the second inner edges are both provided in a number of twelve, and the driving slot is formed in a dodecagonal shape.

10. The combination of claim 9, wherein the non-circular outer edge is provided with six corners, and the lengths of two lateral edges that include one corner retained against the first inner edge are equal.

11. The combination of claim 9, wherein the inner edge of the driving slot is embedded with a resilient member.

12. The combination of claim 11, wherein each of the six corners is mounted with an engaging groove for engaging the resilient member.

13. The combination of claim 3, wherein the combining part has plural combining faces, the connecting part has plural connecting faces, and each of the connecting faces is not in parallel against the neighboring combining face.

14. The combination of claim 1, wherein a ball member is disposed on the outer edge of the connecting part, and the first driver is longitudinally provided with a rod for controlling the ball member to optionally engage or disengage the second driver.

* * * * *